United States Patent [19]

Yoshieda et al.

[11] 4,265,014

[45] May 5, 1981

[54] APPARATUS FOR PRESS-BONDING A REINFORCED TAPE TO A SLIDE FASTENER WITH A SEPARABLE END STOP

[75] Inventors: Keiichi Yoshieda, Kurobe; Kazuki Kuse, Toyama, both of Japan

[73] Assignee: Yoshida Kogyo K. K., Tokyo, Japan

[21] Appl. No.: 974,602

[22] Filed: Dec. 29, 1978

[30] Foreign Application Priority Data

Dec. 30, 1977 [JP] Japan ..... 52/160361

[51] Int. Cl.[3] ..... B23P 21/00

[52] U.S. Cl. ..... 29/766; 29/767; 29/408; 156/66; 156/257; 156/513

[58] Field of Search ..... 29/408, 410, 766, 767, 29/33.2, 819; 156/66, 513, 257

[56] References Cited

U.S. PATENT DOCUMENTS

| | | | |
|---|---|---|---|
| 3,106,941 | 10/1963 | Plummer | 156/257 |
| 3,190,779 | 6/1965 | Porepp | 29/408 |
| 3,340,594 | 9/1967 | Fröhlich et al. | 29/408 |
| 3,353,256 | 11/1967 | Fröhlich et al. | 29/766 |
| 3,793,719 | 2/1974 | Ebata | 29/408 |
| 3,872,571 | 3/1975 | Douri | 29/767 |
| 3,884,738 | 5/1975 | Hofius, Sr. | 156/513 |
| 4,110,891 | 9/1978 | Akashi | 29/766 |

FOREIGN PATENT DOCUMENTS

| | | | |
|---|---|---|---|
| 449093 | 6/1936 | United Kingdom | 29/410 |

*Primary Examiner*—Daniel C. Crane

*Attorney, Agent, or Firm*—Hill, Van Santen, Steadman, Chiara & Simpson

[57] ABSTRACT

A method and an apparatus for press-bonding a reinforcement tape of plastic film onto a space section of a continuous length slide fastener chain, the method and the apparatus comprising means for positioning the space section of the fastener chain between an upper presser and a lower presser providing the reinforcement tape with a cut-out to fit the element rows of the fastener chain, transferring a continuous length reinforcement tape by a predetermined distance in a direction perpendicular to the movement of the fastener chain so that the cut-out is located just on the space section of the fastener chain between the pressers, closing of the pressers to effect press-bonding of the reinforcement tape to the space of the fastener chain either by heat melting or by high-frequency welding, and simultaneously cutting the reinforcement tape with a cutter blade.

4 Claims, 16 Drawing Figures

APPARATUS FOR PRESS-BONDING A REINFORCED TAPE TO A SLIDE FASTENER WITH A SEPARABLE END STOP

BACKGROUND OF THE INVENTION

1. Field of the Invention

The present invention relates to a method for press-bonding a reinforcement tape to a slide fastener with a separable end stop, and an apparatus therefor.

2. Prior Art

In order to facilitate opening and closing of a separable end stop provided at the lower end of a slide fastener, it is customary that a reinforcement tape made of a plastic resin film is bonded to the lower ear portions of the carrier tapes of both fastener stringers adjacent to the lower ends of the rows of the fastener elements to impart improved rigidity. It is also desirable that the reinforcement tape is bonded not only to the space section of the fastener chain, which is void of the fastener elements, but also with the reinforcement tape extending to the side portions of the carrier tapes so that distortion of the lower part of the fastener chain can be prevented which otherwise often occurs.

To simplify and facilitate the assembling and finishing of slide fasteners, it is a common practice of the slide fastener manufacturers to first prepare a continuous length slide fastener chain carrying thereon uninterrupted rows of the fastener elements, and then to remove a certain number of the fastener elements in a section at regular intervals to form so-called space sections where the fastener chain is subsequently cut into the individual product length. Therefore it is a convenient way to bond a reinforcement tape onto the space section of the fastener chain before cutting the chain into the product length one by one, and then the fastener chain with the reinforcement tape is cut along a cutting line within the space section.

In the prior art, a continuous process apparatus for press-bonding reinforcement tapes to a continuous length fastener chain is disclosed (see, for example, Japanese Patent Publication No. SHO 44-14392) in which a continuous length reinforcement tape and the continuous length fastener chain are transferred in the same direction. The problems with such an arrangement of the apparatus are (1) that exact positioning of the tape relative to the fastener chain is rather difficult with frequent displacement of the reinforcement tape out of the exact positions and (2) that compactness of the apparatus can hardly be obtained. In addition, the reinforcement tape bonded with such an apparatus is necessarily in a rectangular form lying at the lower end of the element rows perpendicularly to the direction of the element rows. With such an arrangement no protection is imparted to several pairs of the elements positioned near the lower end of the element rows which should desirably be protected with a reinforcement tape from deformation due to repeated opening and closing of the fastener chain, having a separable end stop.

SUMMARY OF THE INVENTION

An object of the present invention is to provide a novel method for press-bonding a reinforcement tape to a fastener chain on the portions extending from the lower end of the element rows to the sides of the rows of the fastener elements covering several pairs of the elements, and also to provide an apparatus for practicing such method conveniently.

Another object of the present invention is to provide a method for press-bonding a reinforcement tape to a slide fastener chain fully automatically or at least automatically except for the manual transfer of the fastener chain, and also to provide an apparatus therefor.

Still another object of the present invention is to provide a method for press-bonding a reinforcement tape to a slide fastener chain in which the press-bonding can be effected either by heat-melting or by high-frequency welding, and also to provide an apparatus therefor.

The method of the present invention comprises the steps of (a) positioning a continuous length slide fastener chain, having space sections at intervals, between a forming die or a lower presser and a forming punch or an upper presser so that a space section thereof is located between the forming die and the forming punch, (b) forming a cut-out by punching along a periphery of a continuous length tape of a thermo-plastic resin film running in the direction perpendicular to the fastener chain, (c) transferring the punched tape at a predetermined distance so that the cut-out is positioned just above the space section of the fastener chain located between the forming die and the forming punch, and (d) pressing the tape onto the fastener chain by operating the forming die to effect bonding of the tape to the fastener chain.

The apparatus of the present invention constructed for conveniently practicing the above method comprises (1) a forming punch or an upper presser, (2) a forming die or a lower presser positioned below the forming punch and relatively movable toward and away from the forming punch, (3) a pair of chain guide units positioned on both sides of the forming die for guiding and holding a fastener chain, (4) a tape guiding and holding mechanism having a pair of guide rams movable in the direction perpendicular to the tape to enter and come out of the space between the forming die and the forming punch, (5) a feeding unit for feeding a tape into the tape guiding and holding mechanism, (6) a tape punching unit positioned between the tape-feeding unit and the tape guiding and holding mechanism and (7) a tape cutting unit.

BRIEF DESCRIPTION OF THE DRAWINGS

FIGS. 1 to 9 illustrate an embodiment of the apparatus of the present invention, in which:

FIG. 1 is an elevational side view;

FIG. 2 is an elevational side view partly in cross section;

FIG. 3 is a cross sectional view of the apparatus taken along the line III—III in FIG. 1;

FIG. 4 is a cross sectional view similar to FIG. 3 in which individual parts are in the positions of press-bonding;

FIG. 5 is an enlarged elevational front view in the area shown by the line V—V in FIG. 1, partially in cross section;

FIG. 6 is a cross sectional view of parts at the moment of press-bonding, punching and cutting;

FIG. 7 is a cross sectional view taken along the line VII—VII in FIG. 3;

FIG. 8 is a cross sectional view corresponding to FIG. 7 showing the movement of the parts due to the raising of the die plate; and FIG. 9 is a schematic perspective illustration of the main parts of the apparatus:

FIGS. 10 to 14 illustrate another embodiment of the invention, in which:

FIG. 10 is a cross sectional side view of the main part;

FIGS. 11 and 12 are cross sectional views of the main part showing the functions of press-bonding, punching and cutting;

FIG. 13 is a cross sectional view taken along the line A—A in FIG. 10; and

FIG. 14 is a cross sectional view taken along the line B—B in FIG. 13.

DETAILED DESCRIPTION OF THE PREFERRED EMBODIMENTS

Figure 1:
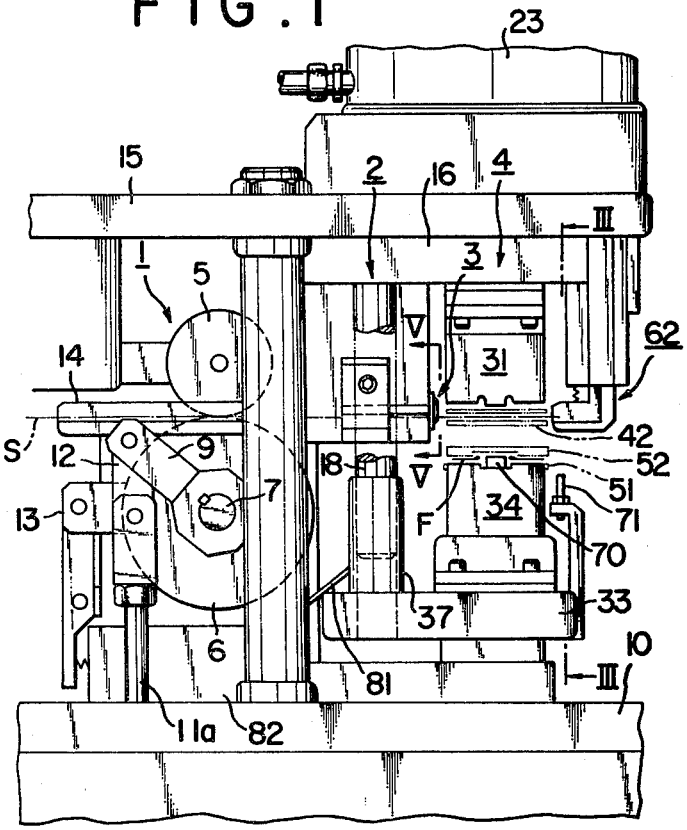
Figure 2:
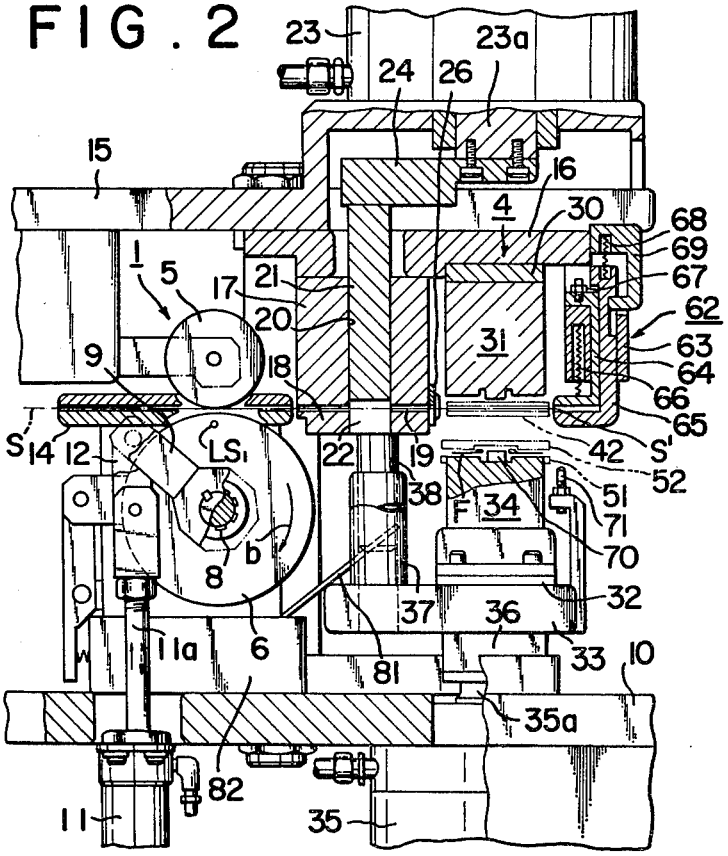
Figure 9:
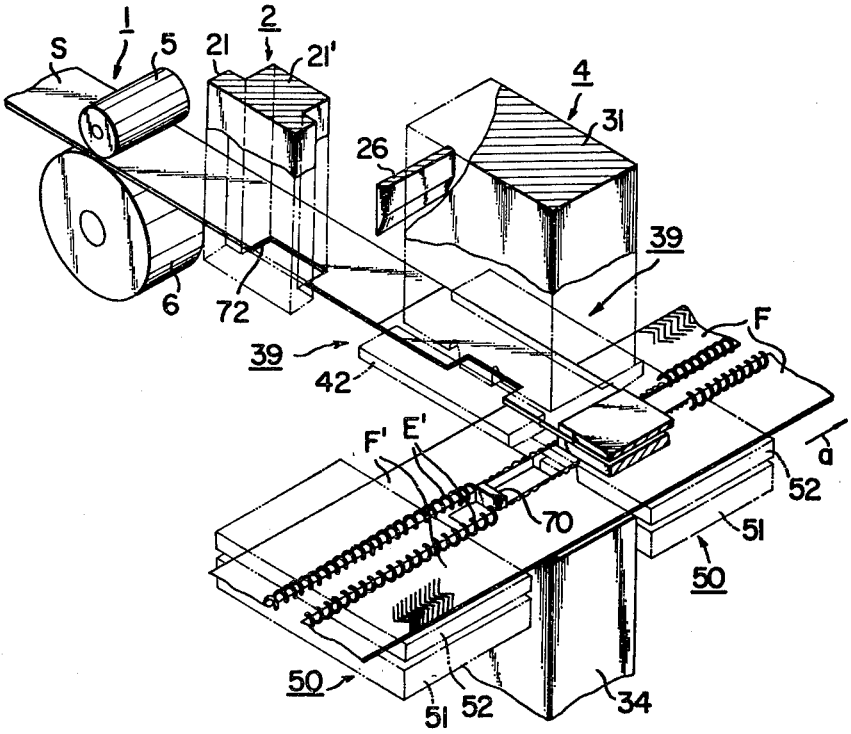

In FIGS. 1, 2 and 9 of the drawing, 1 is a tape-feeding unit, 2 is a tape-punching unit, 3 is a tape-cutting unit and 4 is a press-bonding unit, these reference numerals generally indicating the respective unit.

The tape-feeding unit 1 has a feeding roller 6 and a pressure roller 5 rotating as the former rotates. The feeding roller 6 is secured to an axle 7 through a one-way clutch 8, there being an arm 9 secured to the axle 7 and being connected by a link 12 to a piston rod 11*a* of a cylinder 11 fixed to a lower frame 10. A brake shoe 13 prevents reverse rotation of the feeding roller 6, there being a tape guide 14 adjacent to the nip of the rollers 5, 6.

Figure 5:
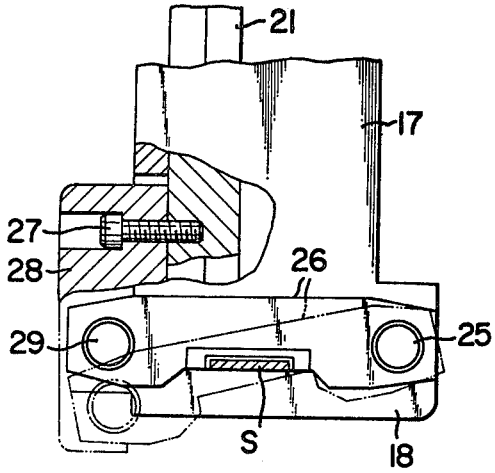

The tape-punching unit 2 is disposed at the front of the tape guide 14 and has a die 18 and a punch guide 17 fixed to an upper frame 15 with a punch plate 16 therebetween. A tape-guide slit 19 is disposed between the punch guide 17 and the die 18, and the punch guide 17 has a vertical punch-guide groove 20, into which a notching punch 21 fits with free sliding movement. As shown in FIG. 9, the punch 21 has a projecting part 21' which fits into a die aperture 22 in the die 18 when the punch 21 is lowered. The punch 21 is connected by a connection piece 24 to the piston rod 23*a* of a cylinder 23 secured to the upper frame 15. As shown in FIG. 5, a cutter 26 pivotally supported by a pivot pin 25 is in sliding contact with the front surfaces of the punch guide 17 and the die 18. The cutter 26 is connected by a pin 29 to a holder 28 which is fixed to the punch 21 by a bolt 27.

The press-bonding unit 4 has a forming punch or an upper presser 31 supported by the punch plate 16 with a heat-insulation plate 30 therebetween, and a forming die or lower presser 34 supported by a die plate 33 with another heat-insulation plate 32 intervening therebetween. Each of the forming punch 32 and the forming die 34 has a built-in heater element (not shown for press-bonding by heat. The die plate 33 is fixedly connected by a connecting piece 36 to a piston rod 35*a* of a cylinder 35, which is fixed to the lower frame 10. The vertical movement of the piston rod 35*a* is guided by a pair of guide bushing 37 fixed to the die plate 33 slidable on a pair of guide pins 38.

Figure 3:
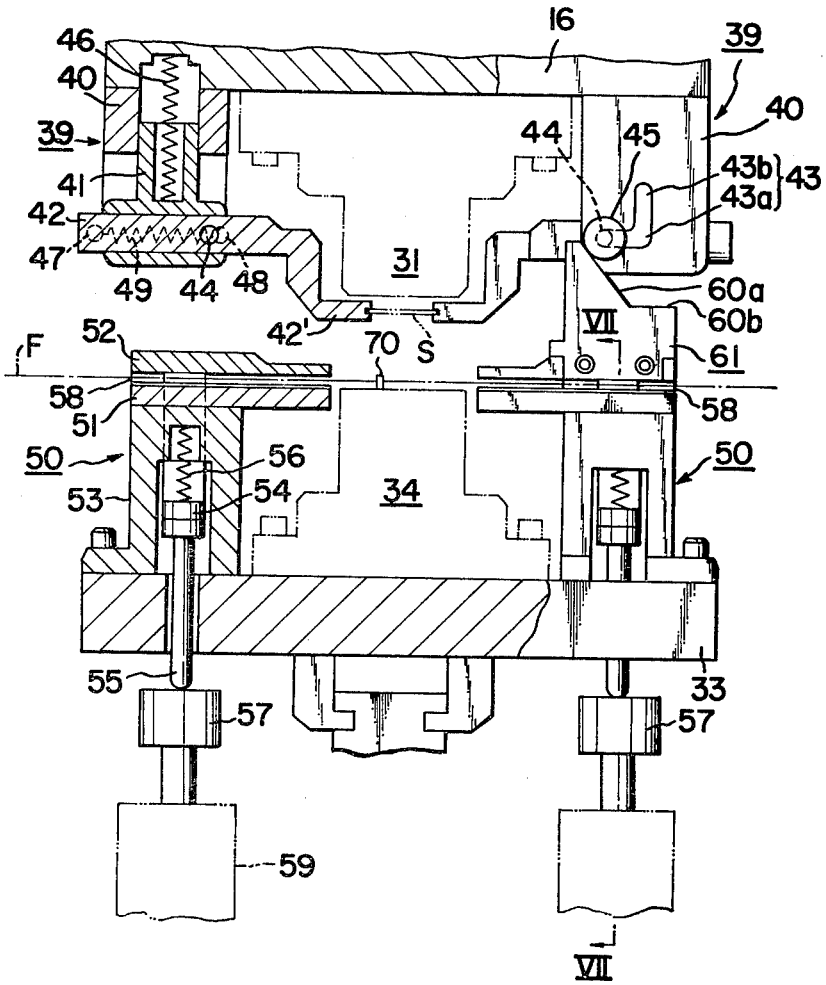
Figure 4:
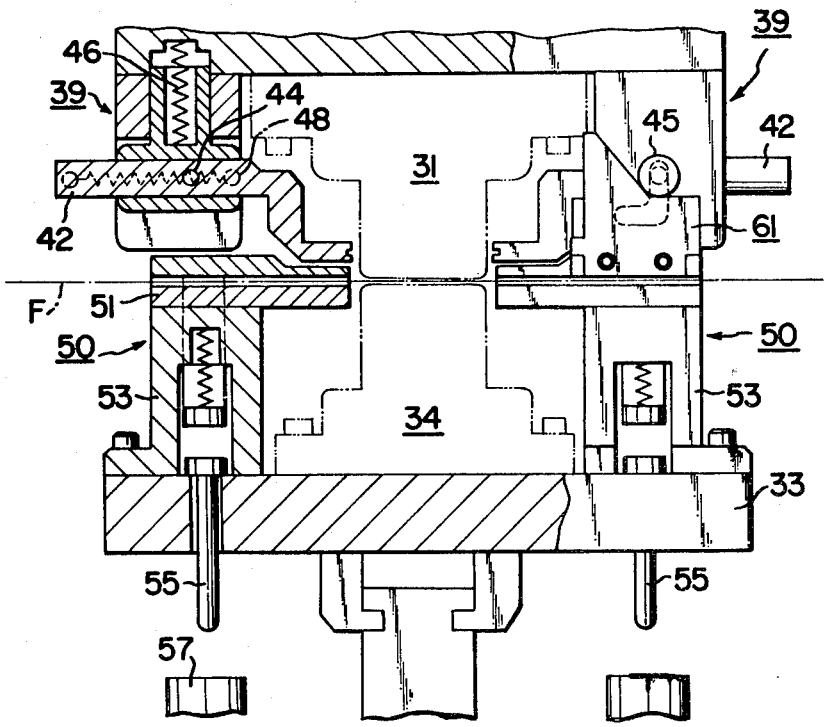

A tape-guide unit 39, 39 is disposed on each side of the forming punch 31 as shown in FIGS. 3, 4 and 9. Each of the tape-guide units 39, 39 has a guide-ram holder 41 slidably supported by a supporting member 40 fixed to the punch plate 16, and a guide ram 42 slidably carried on the guide-ram holder 41. The supporting member 40 has a cam groove 43 composed of a horizontal branch 43*a* and a vertical branch 43*b*, there being a guide pin 44 fixed to the guide ram 42 and protruding outwardly through the cam groove 43. The guide pin 44 also serves as the axle for a cam roller 45. The guide-ram holder 41 is biased downwardly by a compression spring 46. The guide ram 42 is pulled inwardly, i.e. toward the forming punch 31, by a tension spring 49 horizontally bridging a spring-engaging pin 47 fixed thereto and another spring-engaging pin 48 fixed to the supporting member 40. The lower end of the guide ram 42 is a tape guide 42' extending below the forming punch 31.

A chain-guide unit 50, 50 is disposed on each side of the forming die 34 as shown in FIGS. 3, 4, 7, 8 and 9. Each of the chain guide units 50, 50 has a fixed stationary guide plate 51 and a movable guide plate 52 disposed thereabove. The stationary guide plate 51 is mounted fixedly onto a guide support 53 which is fixed to the die plate 33. The movable guide plate 52 is mounted on a lifter 54 which is in contact with a pin 55 projecting through the die plate 33. The movable guide plate 52 is biased downwardly by a compression spring 56 bridging the guide support 53 and the lifter 54 which is integral with the moving guide plate 52 a chain guide slit 58 of a definite width is defined between the stationary guide plate 51 and the movable guide plate 52 when the lifter 54 is pushed upwardly by a pin support 57 which is moved up and down by a cylinder 59. The movable guide plate 52 has a cam 61 fixedly mounted thereon having a cam surface divided into a sloped surface 60*a* and a horizontal surface 60*b* engaging the cam roller 45.

At the front of the forming punch 31, i.e. at the right side of FIGS. 1 and 2, a tape gripper unit 62 is disposed. The tape gripper unit 62 is composed of a holder 63 fixed to the punch plate 16 and a set of upper and lower gripper plates 64, 65 supported by the holder 63 with free vertical movability and with mutual sliding movability. The upper gripper plate 64 is biased downwardly by a spring 66 and engages with the holder 63 by means of a stop screw 67 while the lower gripper plate 65 is biased downwardly by a spring 68 and held by a stop 69.

The steps for performing press-bonding of the reinforcement tape to a fastener chain by use of the above described apparatus are described in sequence.

First, the guide pin supports 57 are elevated by actuating the cylinders 59 for the chain guide by energizing, for example, a foot switch (not shown). The movable guide plates 52 are elevated as pushed by the pins 55 acting through the lifters 54 so that the chain guide slits 58 between the movable guide plates 52 and the stationary guide plates 51 become opened sufficiently. The end of a fastener chain F separated over a length is passed through the opened chain guide slits 58. The chain is held gently between the stationary guide plate 51 and the movable guide plate 52 of each of the chain guide units 50, 50 by the lowering of the movable guide plates 52 into the positions shown in FIGS. 3 and 4 by de-energizing the foot switch to retract the cylinders 59. The next step is to pulling the fastener chain F manually in the forward direction, i.e. in the direction shown by the arrow a in FIG. 9, until the movement of the fastener chain F is interrupted by the leading elements' of the next-coming rows of the elements E' following a space section engaging with a stop 70 carried in the middle of the forming die 34 to complete the transfer and positioning of the fastener chain F. Thus the pairs of guide plates 51, 52 press-hold the fastener chain at the opposite sides of a space section with an appropriate pressure to tension the space section so that any distortion or wrinkle is smoothed out.

Then a hand switch (not shown) for the control of tape-feeding is energized to actuate the cylinder 11 whereby the piston rod 11*a* is elevated and the feeding roller 6 is rotated in the direction of the arrow b in FIG. 2 to effect an incremental transfer of the tape S for a predetermined distance. The tape S passes through the tape-guide slit 19 between the punch guide 17 and the die 18, while being guided by the guide rams 42 of the tape-guide mechanisms 39. The front end S' of the tape S reaches the tape gripper unit 62 where the end S' of the enters the clearance space between the upper and lower gripper plates 64 and 65 a little to complete the incremented transfer of the tape. The completion of the transfer of the tape S is detected by a suitable detecting means, for example a limit switch $LS_1$ operated by the movement of the arm 9, to generate a signal which is conducted to initiate the movement of the cylinder 35 to elevate the die plate 33 together with the forming die 34 and the chain guide units 50. Further the elevation of the die plate 33 brings each of the cams 61 fixed to the movable guide plates 52 into contact with the cam roller 45 whereupon the cam roller 45 is pushed first by the sloped surface 60*a* of the cam 60 to effect outward shift of the pin 44 in the horizontal branch 43*a* of the cam groove 43 so that the tape guide ram 42 is horizontally pushed aside to a position out of the path of the forming punch 31. At this moment, the tape guide rams 42 release the tape S but the tape S never becomes slackened since the end S' of the tape S is gripped by the tape gripper unit 62. In the next step, each of the cam rollers 45 contacts the horizontal cam surface 60*b* so that the pin 44 is elevated in the vertical branch 43*b* of the cam groove 43 whereby the tape guide ram 42 is elevated together with the guide ram holder 41 to the positions shown in FIGS. 4, 6. Also a stop 71 (FIGS. 1, 6) fixed to the die plate 33 is brought into contact with the lower surface of the lower gripper plate 65 to enable the gripper plates 64, 65 to firmly grip the front end S' of the tape S. Also the forming die 34 coacts with the forming punch 31 to start press-bonding of the tape to the space section of the chain F along with punching.

Figure 6:
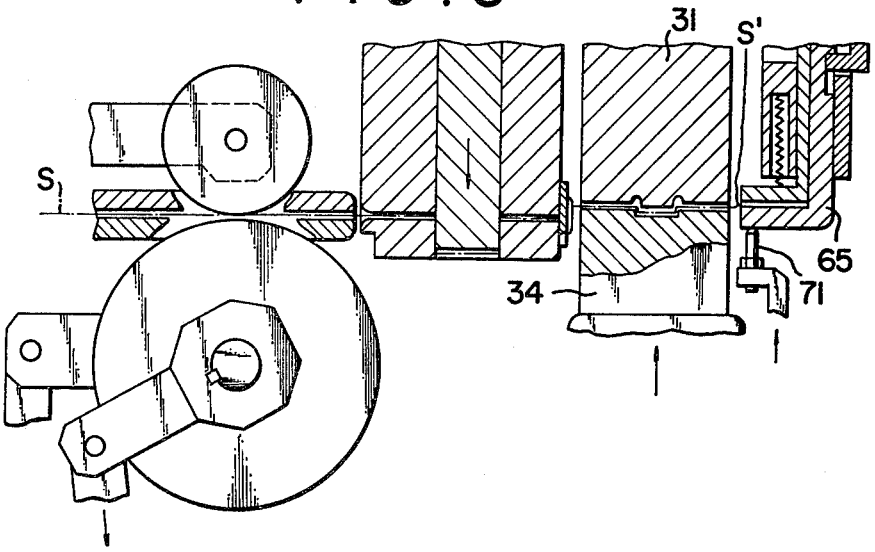
Figure 7:
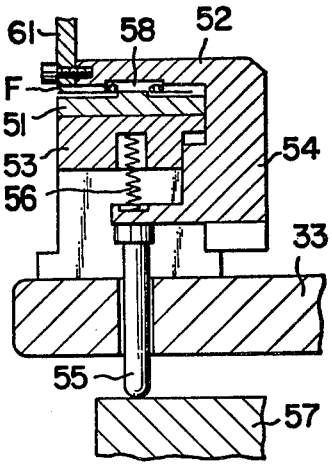
Figure 8:
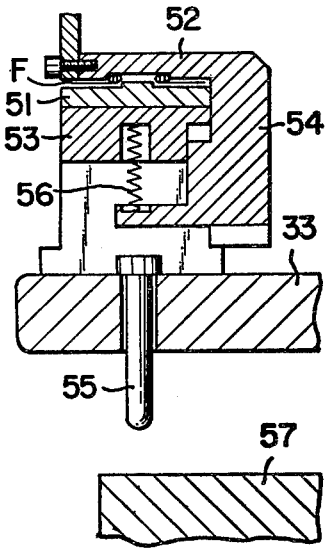

The completion of the elevation of the forming die 34 to the position shown in FIG. 6 is detected by a limit switch (not shown) to generate a signal for starting a timer switch, and when the time interval set in the timer switch has come to the end, the cylinder 35 retracts the forming die 34, the chain-guide units 50 and the tape-guide units 39 to the positions shown in FIG. 3.

Figure 15:
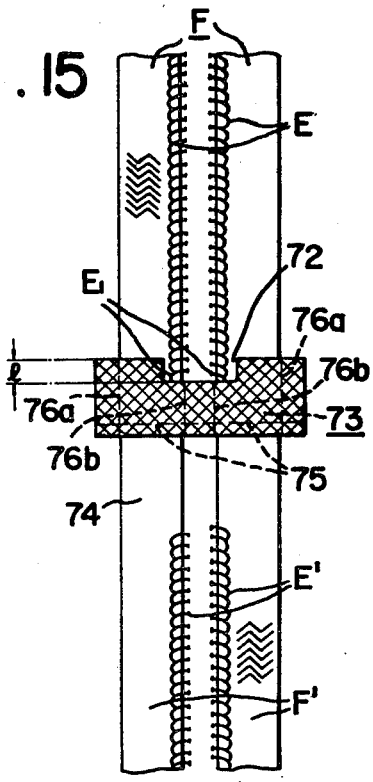
FIG. 15 is a plan view of a fastener chain with a reinforcement tape bonded to the space section.

In addition, another timer switch is turned on and, at the end of a time interval set in this timer switch, the cylinder 23 for the punch 21 is operated to lower the punch 21 whereby punching of the tape is performed in the next-coming portion of the tape before the beginning of the lowering of the forming die 34 to form a cut-out 72 along the periphery of the tape as is shown in FIG. 9 or FIG. 15. The scraps of the tape, formed by such punching, slide down on a scrap chute 81 and are collected in a scrap box 82 to be discarded. With the descending of the punch 21, the rotatable cutter blade 26 rotates around the pivot pin 25 to cut the tape off as is shown in FIG. 5. When the punching and cutting have come to completion, the cylinder 23 immediately is retracted so that the punch 21 and the cutter 26 are restored to their initial positions to complete a cycle of steps. By the repetition of the above described cycle of steps, a continuous length fastener chain provided with the reinforcement tapes press-bonded on the individual space sections is obtained in a continuous process.

FIG. 15 depicts a fastener chain provided with a reinforcement tape as finished in accordance with the present invention. A reinforcement tape 73 with the cut-out 72 is bonded to a space section 74 between two successive portions F, F' of the fastener chain having element rows E, E', respectively. The position of the reinforcement tape on the fastener chain extends over a prospective cutting line 75 along which the fastener chain is to be cut into separate fastener chains F and F'. In the next step, the fastener chain thus provided with reinforcement tapes at intervals is passed through a cutting apparatus (not shown) in which cutting of the fastener chain along the cutting lines 75 is performed with simultaneous cutting of the reinforcement tape 73 along a pair of cutting lines 76*a* and 76*b*. Thus an individual fastener chain has a reinforcement tape bonded in such a manner that the lower end of the element row E is embraced at both sides within the cut-out 72 by the length l of reinforcement tape 73 in the longitudinal direction so that the elements $E_1$ in this range are protected by the reinforcement tape 73. The protection obtained with the novel L-shaped reinforcement tape is very significant because the elements in this range have the largest likelihood of deformation and displacement.

Figure 10:
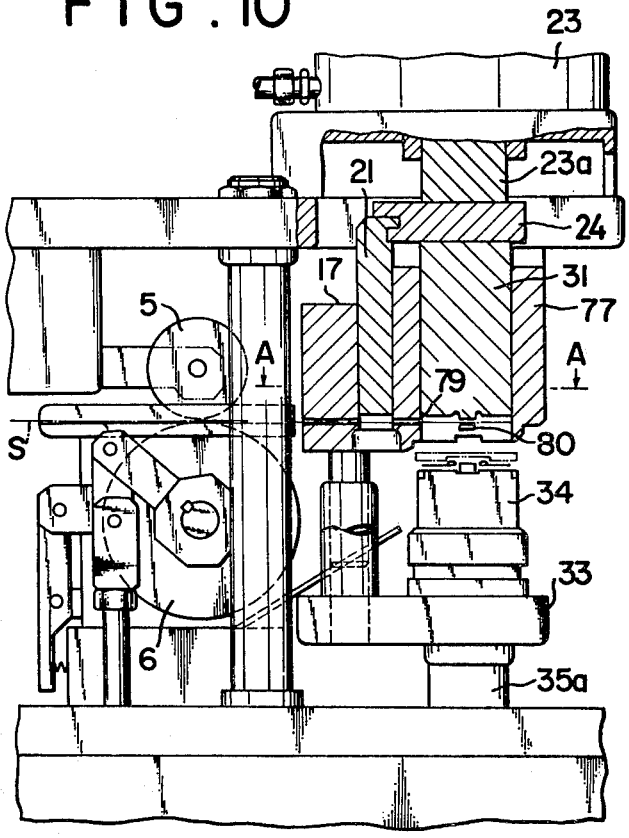
Figure 11:
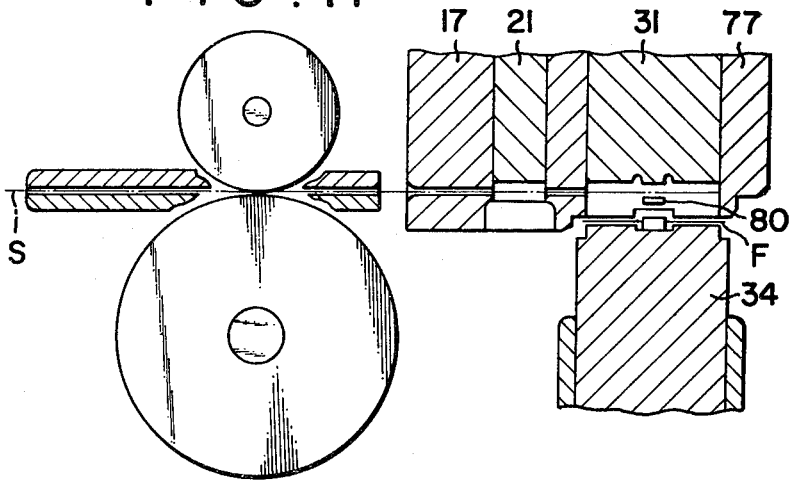
Figure 12:
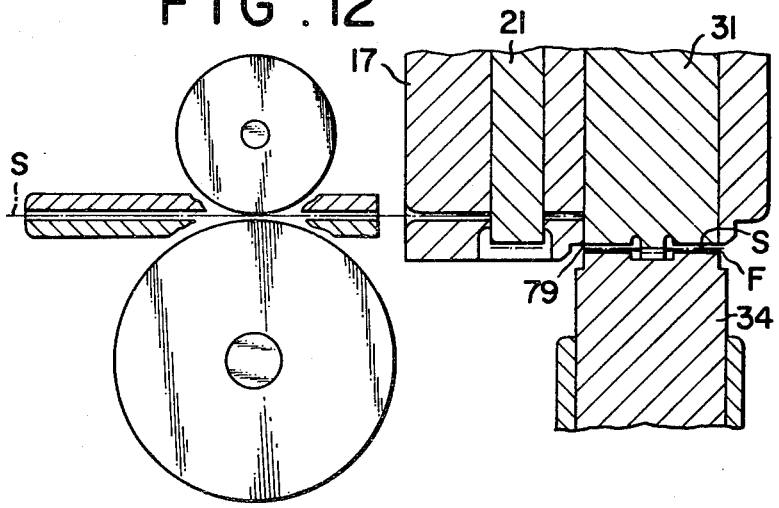
Figure 13:
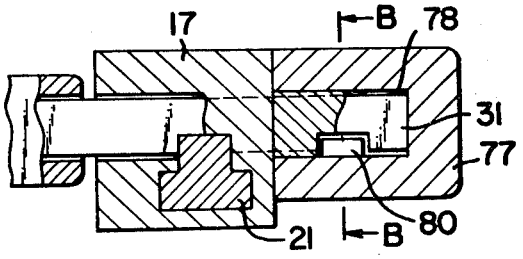
Figure 14:
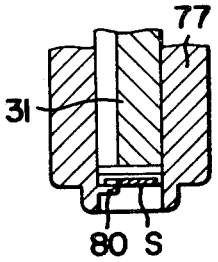

FIGS. 10 to 14 illustrate another embodiment of the present invention in which press-bonding of the reinforcement tape to the fastener chain is performed by high-frequency welding. An advantage of the high-frequency welding is the possibility of simplification of the structure of the apparatus in comparison with the first described embodiment owing to the absence of heat propagation from the bonding part to the other parts of the apparatus. Thus, as shown in FIGS. 10 and 13, a forming-punch guide 77 is disposed at the front of the punch guide 17 and the forming punch 31 is movable vertically within a cavity 78 defined by the forming-punch guide 77 and the front surface of the punch guide 17. Both the punch 21 and the forming punch 31 are connected to the piston rod 23*a* of the cylinder 23 with a connection piece 24. The rear surface of the forming punch 31, i.e. the end surface coming into sliding contact with the front surface of the punch guide 17, is shaped in the form of a cutter blade 79 at the lower end thereof. The forming-punch guide 77 has a guide piece 80 in the lower part thereof protruding into the cavity 78 in order to prevent distortion of the tape. In this embodiment, no tape gripper unit is provided, although it is optional to have such a unit if needed as determined by the rigidity of the reinforcement tape. The forming die 34 and the chain-guide unit 50 have structures which are the same as in the first embodiment except the cam 61 of the first embodiment is unnecessary. The positioning of the fastener chain F during its insertion in the apparatus, the incremental transfer of the tape S and the elevation of the forming die 34 are performed in the same manner as in the first embodiment as shown in FIG. 11. The next step is the lowering of the punch 21 and the forming punch 31 by means of the cylinder 23 to effect simultaneous punching of the tape by the punch 21 and cutting of the tape by the cutter blade 79 on the lower end of the rear surface of the forming punch 31 followed by further lowering of the forming punch to the position shown in FIG. 12 where high-frequency welding of the tape S to the fastener chain F is performed while being pressed onto the chain F.

Apart from the above description in which the transfer and positioning of the fastener chain are performed manually, it is possible to mechanize the steps. For example, suitable means such as chain feed rollers are provided at the front and rear of the chain guide units 50, 50 for the automatic transfer of the fastener chain. The rotation of these chain feed rollers is controlled by a signal generated in a limit switch which is energized when the upper end of the element rows engages with the stop 70, the stop 70 being capable of projecting and retracting, and being installed between the chains F, F. After completion of bonding of the tape to the fastener chain, the transfer of the fastener chain is resumed by the retraction of the stop to a position below the fastener chain with subsequent projection of the stopper when the next space section 74 has arrived so that the stop may engage the upper end of the next rows of the elements. With this construction of the apparatus, the whole process of the press-bonding of the reinforcement tape can be operated fully automatically except for the insertion of the tape end at the start of the machine operation.

Figure 16:
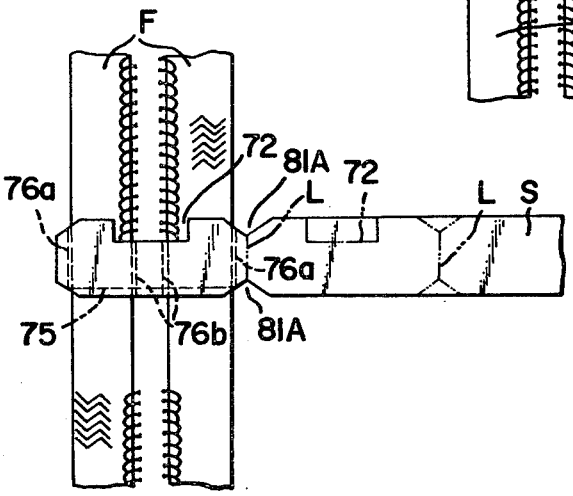
FIG. 16 is an alternative plan view of a fastener chain showing the bonding condition of the reinforcement tape onto the space section.

FIG. 16 depicts an alternative example of the reinforcement tape to be bonded to the fastener chain in which further V-shaped cut-outs, 81A are provided along the peripheries of the tape S in addition to the cut-out 72 in positions registering with the prospective cutting lines L as cut by the cutter 26 or cutter blade 79. With this arrangement of the cut-out 81A in the continuous length tape, the resultant reinforcement tape S bonded to the fastener chain and cut along the cutting lines L has a triangular cut at each of the four corners which facilitate the cutting along the cutting line 76*a* and prevention of peeling of the bonded tape starting at the corners. The only additional modification of the apparatus required for forming such V-shaped cut-outs is a pair of punches with triangular cross sections provided in the punch guide 17 in addition to the punch 21.

As is described above, the continuous length fastener chain and the continuous length reinforcement tape are each transferred in increments in perpendicular crossing with each other to effect press-bonding along with punching and cutting of the tape so that exact positioning of the tape on the fastener chain can be readily obtained with a possibility of full automation for the continuous process of the press-bonding of the reinforcement tape onto the individual space sections of the fastener chain.

In addition, the reinforcement tape bonded to the fastener chain by the method and apparatus of the present invention may have cut-outs to form portions extending to both of the lateral sides of the element rows to give a distinguishable advantage over the prior art method and apparatus so that extended serviceable life is imparted to the resultant slide fasteners with separable end stops by virtue of the reinforcement embracing several of the elements in the lower end of the element rows.

Moreover, the apparatus of the present invention has advantages in addition to the above in that inexact positioning and deformation of the tape can be avoided because the tape is held just before the press-boding by the retractable tape guide rams disposed between the chain-guide units and the forming punch and in that the fastener chain is guided and held at the exact position by the chain-guide units so that the reinforcement tape can be bonded to the fastener chain in the exact bonding position.

What is claimed is:

1. An apparatus for press-bonding a reinforcement tape of thermoplastic resin film onto a space section of a continuous length slide fastener chain having a series of space sections at intervals, comprising:

(a) a forming punch;

(b) a forming die disposed below said forming punch, normally spaced therefrom and being relatively movable toward and away from said forming punch;

(c) a pair of chain guide units disposed one on each side of the forming die for guiding and holding the fastener chain as said chain moves along a path;

(d) a tape guiding and holding unit having a pair of guide rams movable in a direction perpendicular to said path for entering and coming out of the space between said forming die and said forming punch;

(e) a feeding unit for feeding the tape into said tape guiding and holding unit;

(f) a tape punching unit disposed between said tape feeding unit and said tape guiding and holding unit and having a vertically movable tape punch; and (g) a tape cutting unit disposed between said tape punching unit and said tape guiding and holding unit.

2. An apparatus according to claim 1, (a) said tape punching unit including (1) a vertically movable tape punch; and (2) a guide having an inner surface for guiding said punch, and an outer vertical side surface; and (b) said tape cutting unit including (3) a cutter blade pivotably carried on said guide in contact with said vertical side surface; and (4) a linkage interconnecting said tape punch and said cutter blade.

3. An apparatus according to claim 1, said forming punch being vertically movable, and said tape cutting unit being a cutter blade formed as the lower edge of a side surface of said forming punch.

4. An apparatus according to claim 1, said tape guiding and holding unit including;

(a) a stationary guide plate;

(b) a movable guide plate movable vertically in relation to said stationary guide plate; and (c) a spring biasing said movable guide plate toward said stationary guide plate.

* * * * *